US005549082A

United States Patent [19]

Kobayashi

[11] Patent Number: 5,549,082

[45] Date of Patent: Aug. 27, 1996

[54] AIR VENT STRUCTURE FOR PLUG CAP

[75] Inventor: Yoshinao Kobayashi, Yokkaichi, Japan

[73] Assignee: Sumitomo Wiring Systems, Ltd., Japan

[21] Appl. No.: 328,705

[22] Filed: Oct. 25, 1994

[30] Foreign Application Priority Data

Nov. 1, 1993 [JP] Japan ..... 5-063653 U

[51] Int. Cl.[6] ..... F02P 23/00

[52] U.S. Cl. ..... 123/143 C

[58] Field of Search ..... 123/143 C, 195 C, 123/169 PH, 198 E, 169 PA; 439/125–130; 200/19

[56] References Cited

U.S. PATENT DOCUMENTS

| | | | |
|---|---|---|---|
| 4,205,642 | 6/1980 | Nishimura et al. | 123/143 C |
| 4,637,358 | 1/1987 | Yano et al. | 123/169 PA |
| 4,906,202 | 3/1990 | Germ | 439/127 |
| 5,302,131 | 4/1994 | Heritier-Best et al. | 439/127 |
| 5,377,640 | 1/1995 | Kobayashi | 123/143 C |
| 5,462,023 | 10/1995 | Furuya | 123/143 C |

FOREIGN PATENT DOCUMENTS

| | | | |
|---|---|---|---|
| 488216 | 6/1992 | European Pat. Off. | F02P 9/00 |
| 27581 | 8/1989 | Japan | H01T 13/04 |
| 59786 | 8/1993 | Japan | H01T 13/04 |
| 2165000 | 4/1986 | United Kingdom | F02F 1/24 |

*Primary Examiner*—Raymond A. Nelli

*Attorney, Agent, or Firm*—Jordan B. Bierman; Bierman and Muserlian

[57] ABSTRACT

A plug cap includes a plug cap body and a rain cover (24) having an air vent aperture (28) for communication between a spark plug mounting hole and the atmosphere. There is provided a sealing member (29) including a shaft portion (30) extending through the air vent aperture (28) and movably inserted therein with play and valve portions (31, 32) formed on projecting portions at opposite ends of the shaft portion (30) and having sizes larger than that of the air vent aperture (28). The shaft portion (30) includes a tapered shaft portion (**30*b*) for closing an outer edge of the air vent aperture (28) by movement of the sealing member (29) toward the spark plug mounting hole, and a vent (33) for communication between the spark plug mounting hole and the atmosphere by movement of the sealing member (29**) away from the spark plug mounting hole. An air vent structure for the plug cap reliably prevents water from entering the spark plug mounting hole.

9 Claims, 8 Drawing Sheets

AIR VENT STRUCTURE FOR PLUG CAP

BACKGROUND OF THE INVENTION

1. Field of the Invention

The present invention relates to an air vent structure for a plug cap applied to a DOHC (double over head camshaft) type gasoline engine and the like.

2. Description of the Prior Art

This type of air vent structure is disclosed in, for example, Japanese Utility Model Application Laid-Open No. 5-59786 (1993). As shown in FIGS. 12 and 13, a plug cap 1 comprises a plug cap body 2 and a rain cover 3. The plug cap 1 is inserted into a spark plug mounting hole 4 to connect an ignition cable 7 to a spark plug 6 mounted to an engine 5 and to close an opening end of the spark plug mounting hole 4 by the rain cover 3.

A vent channel 8 is formed between an outer peripheral surface of an upper end portion of the plug cap body 2 and an inner peripheral surface of the rain cover 3, and an air vent aperture 9 is formed at an upper end of the rain cover 3 for communication between the vent channel 8 and the atmosphere.

A spherical sealing member storage chamber 10 as a larger space is formed in an intermediate portion of the air vent aperture 9, and a sealing sphere 11 is received in the sealing member storage chamber 10.

The sealing sphere 11 normally shuts off the communication through the air vent aperture 9 by gravity, and prevents water from entering the spark plug mounting hole 4 when water enters the sealing member storage chamber 10 from above by a high-pressure jet of water.

When the temperature of the engine 5 rises and air in the spark plug mounting hole 4 thermally expands to increase the internal pressure, the expanded air pushes the movable sealing sphere 11 upwardly to escape outwardly. This prevents an increase in internal pressure of the spark plug mounting hole 4.

However, the conventional structure is constructed such that water enters up to the sealing member storage chamber 10. When the spark plug mounting hole 4 is disposed at a slant, the air vent aperture 9 is slanted as shown in FIG. 14 and the air vent aperture 9 is not shut off by gravity exerted upon the sealing sphere 11, resulting in water in the sealing member storage chamber 10 entering the spark plug mounting hole 4.

SUMMARY OF THE INVENTION

According to the present invention, a plug cap device comprises: a tubular plug cap body removably inserted in a spark plug mounting hole formed adjacent an engine; a rain cover receiving an upper end portion of the plug cap body and closing an opening end of the spark plug mounting hole, the rain cover including an air vent aperture for communication between the spark plug mounting hole and atmosphere; and a sealing member including a shaft portion extending through the air vent aperture for movement with play, and outer and inner valve portions formed on projecting portions at opposite ends of the shaft portion, the outer and inner valve portions being greater in size in a diametrical direction than the air vent aperture, the sealing member further including a closing portion for closing an outer edge of the air vent aperture by movement of the sealing member toward the spark plug mounting hole, and a communicating passage for allowing the spark plug mounting hole to communicate with the atmosphere by movement of the sealing member away from the spark plug mounting hole.

Since the outer edge of the air vent aperture is adapted to be closed, entrance of water into the air vent aperture is effectively prevented is the air vent aperture is disposed at a slant. The spark plug mounting hole is permitted to communicate with the atmosphere to insure air entrance and exit under normal conditions, and entrance of water from the exterior is effectively prevented under abnormal conditions to reliably prevent water from entering the spark plug mounting hole. Further, since the valve portion of the sealing member is exposed to the exterior, the absence or presence of the sealing member relative to the rain cover is advantageously checked without difficulty in process steps of fabrication of the plug cap. The valve portions larger than the air vent aperture are formed at opposite ends of the sealing member to effectively prevent the sealing member from being removed accidentally.

It is an object of the present invention to provide an air vent structure for a plug cap which reliably prevents water from entering a spark plug mounting hole.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
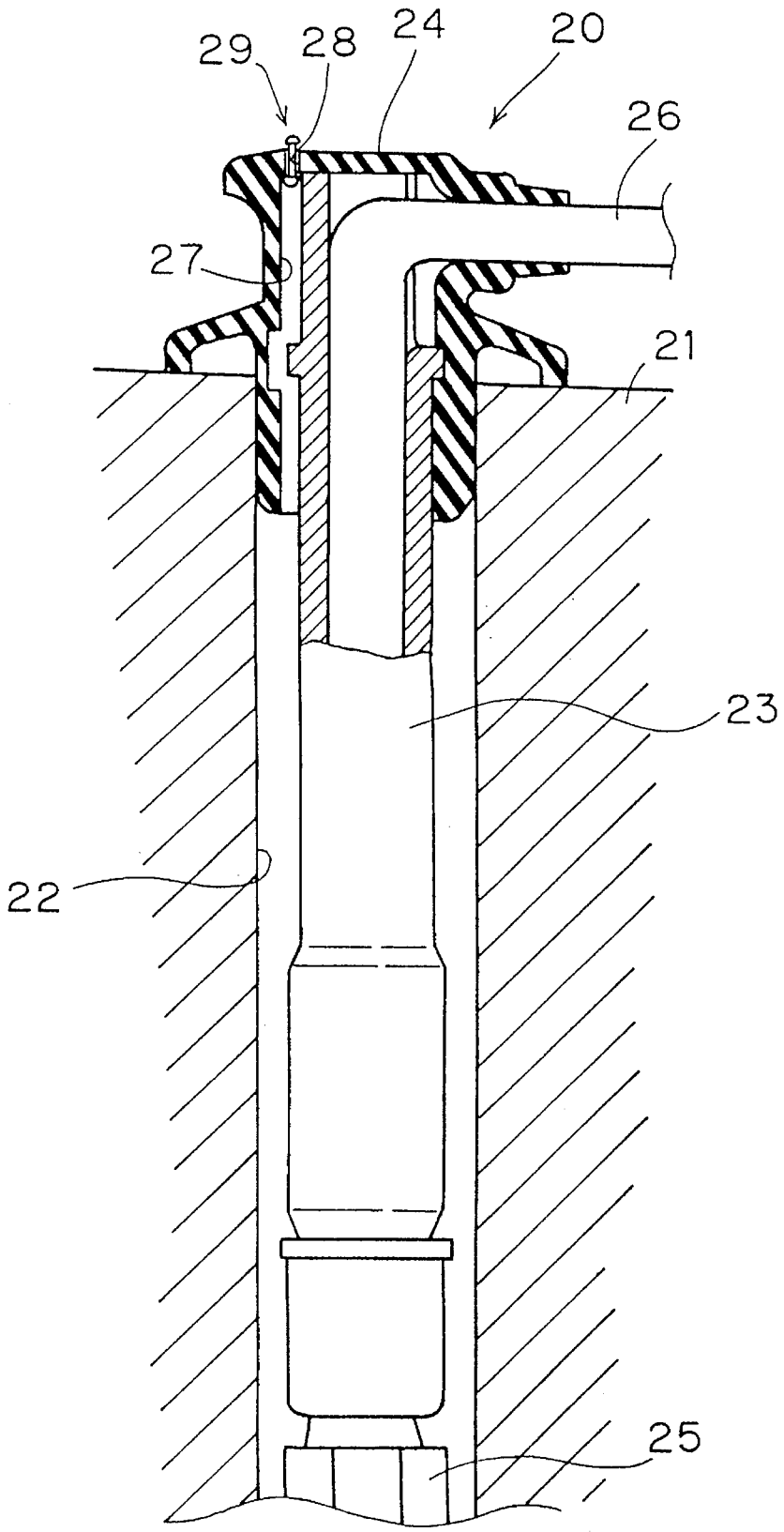
FIG. 1 is a fragmentary sectional view of a first preferred embodiment according to the present invention.

A first preferred embodiment according to the present invention will now be described with reference to the drawings. Referring to FIGS. 1 to 4, a plug cap 20 comprises a tubular plug cap body 23 formed of resin and removably inserted in a spark plug mounting hole 22 formed adjacent an engine 21, and a rain cover 24 made of an elastic material such as rubber and receiving therein an upper end portion of the plug cap body 23. A lower end portion of the plug cap body 23 is inserted into the spark plug mounting hole 22 and an ignition cable 26 is connected to a spark plug 25 mounted to the engine 21 whereby an upper opening end of the spark plug mounting hole 22 is closed by the rain cover 24.

A vertically extending vent channel 27 is formed between an outer peripheral surface of the upper end portion of the plug cap body 23 and an inner peripheral surface of the rain cover 24. A vertically extending circular air vent aperture 28 is formed at an upper end of the rain cover 24 for communication between the vent channel 27 and the atmosphere.

A sealing member 29 made of a synthetic resin is provided through the air vent aperture 28. The sealing member 29 comprises a shaft portion 30 extending through the air vent aperture 28 and inserted therein for vertical movement with play, and outer and inner valve portions 31, 32 formed on projecting portions at upper and lower ends of the shaft portion 30. The outer and inner valve portions 31, 32 have diameters or sizes in a diametrical direction which are greater than the diameter of the air vent aperture 28.

A lower half of the shaft portion 30 is a small-diameter shaft portion **30*a* having a diameter less than that of the air vent aperture 28, and an upper half thereof is a tapered shaft portion 30*b* having a diameter gradually increased in an upward direction from an upper end of the small-diameter shaft portion 30*a*. The diameter of an upper end of the tapered shaft portion 30*b* is greater than the diameter of the air vent aperture 28**.

Figure 2:
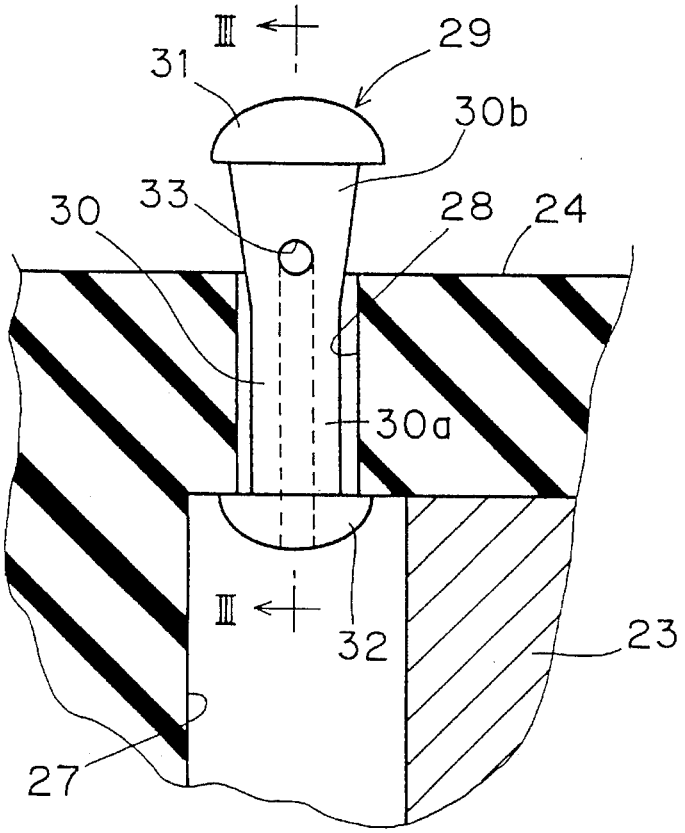
FIG. 2 is an enlarged view of major portions of the first preferred embodiment.
Figure 3:
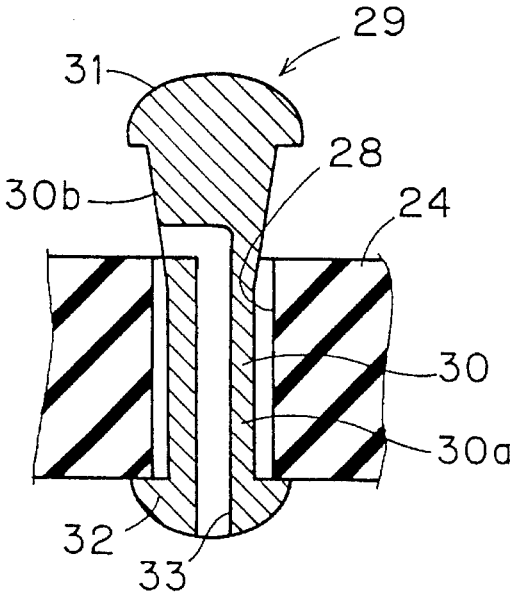
FIG. 3 is a sectional view taken along the line III—III of FIG. 2.

As shown in FIGS. 2 and 3, when the inner valve portion 32 is in contact with a lower end periphery of the air vent aperture 28, a vent 33 is formed which serves as a communicating passage extending from the center of a lower surface of the inner valve portion 32 through the small-diameter shaft portion **30*a* to a side face of the tapered shaft portion 30*b* for communication between the vent channel 27** and the atmosphere.

Figure 4:
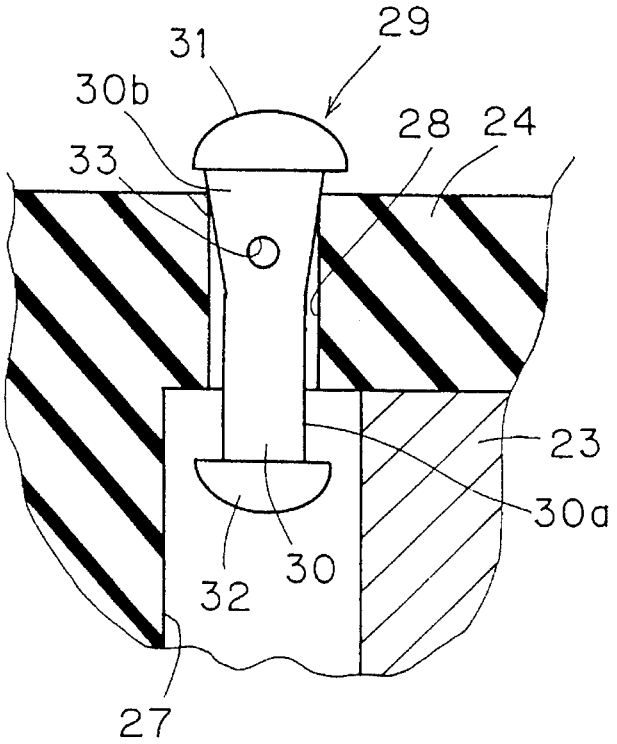
FIG. 4 is an enlarged view of the major portions of the first preferred embodiment in operation.

As shown in FIG. 4, when the sealing member 29 moves downward, an upper edge of the air vent aperture 28 is closed by a large-diameter side of the tapered shaft portion **30*b* in such a manner that an upper end opening of the vent 33 is positioned within the air vent aperture 28. Thus the tapered shaft portion 30*b* forms a closing portion for closing the upper edge of the air vent aperture 28**.

The first preferred embodiment of the present invention is constructed as above described, and the sealing member 29 is forced into and mounted through the air vent aperture 28 by using elastic deformation of the rain cover 24. When the temperature of the engine 21 rises and air in the spark plug mounting hole 22 thermally expands to increase the internal pressure, the expanded air pushes the movable sealing member 29 upwardly into the conditions shown in FIGS. 2 and 3. In this state, the spark plug mounting hole 22 communicates with the atmosphere through the vent channel 27 and the vent 33. This permits the expanded air to escape outwardly to prevent an increase in internal pressure of the spark plug mounting hole 22.

As the engine 21 cools off spontaneously, air in the spark plug mounting hole 22 thermally shrinks slowly to decrease the internal pressure slowly. The atmosphere gradually enters the spark plug mounting hole 22 through a slight gap made between the air vent aperture 28 and the shaft portion 30.

On the other hand, when a high-pressure stream of water is jetted out against the plug cap 20 by a high-pressure vehicle washing machine and the like, the engine 21 is cooled rapidly and air in the spark plug mounting hole 22 thermally shrinks rapidly to decrease the internal pressure rapidly. The rapid heat shrinking of air causes the sealing member 29 to be sucked into the spark plug mounting hole 22, and the upper end periphery of the air vent aperture 28 is closed by the tapered shaft portion **30*b* of the shaft portion 30 into a shut-off state, to prevent suction of water into the spark plug mounting hole 22. Since the upper edge of the air vent aperture 28 is closed, water is not permitted to enter the air vent aperture 28**.

As above stated, the spark plug mounting hole 22 communicates with the atmosphere to ensure air entrance and exit under normal conditions, and water entrance from the exterior is effectively prevented under abnormal conditions, for example when a high-pressure stream of water is jetted out.

Since the outer valve portion 31 of the sealing member 29 is exposed to the exterior, the absence or presence of the sealing member 29 relative to the rain cover 24 is advantageously checked without difficulty in process steps of fabrication of the plug cap 20.

Figure 5:
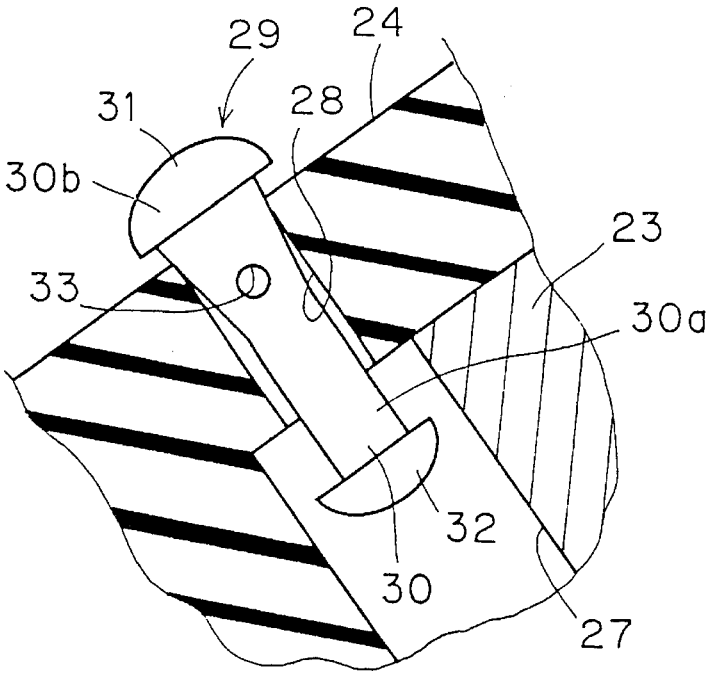
FIG. 5 is an enlarged view of the major portions of the first preferred embodiment when slanted.
Figure 6:
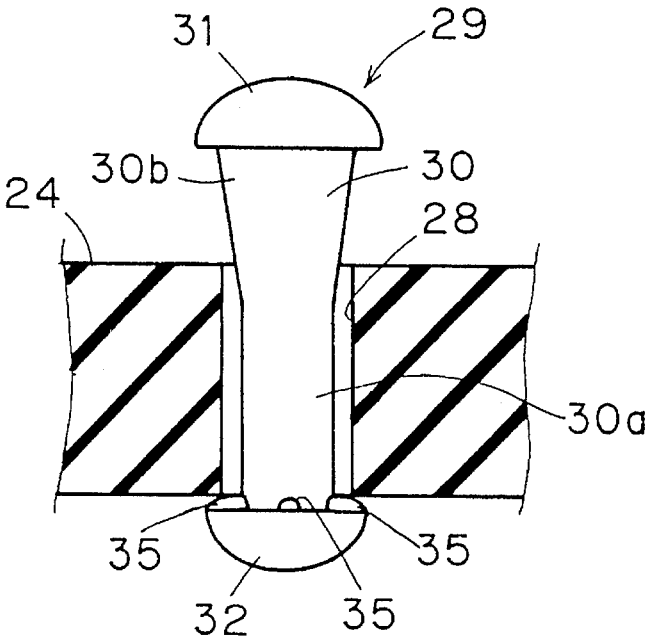
FIG. 6 is an enlarged view of major portions of a second preferred embodiment according to the present invention.
Figure 14:
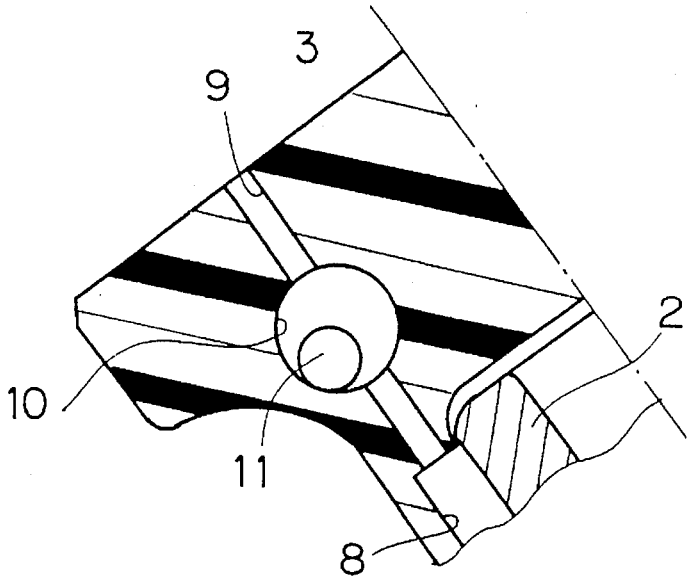
FIG. 14 is an enlarged view of the major portions of the prior art when slanted.

Further, the outer and inner valve portions 31 and 32 having sizes greater than that of the air vent aperture 28 and formed at both ends of the sealing member 29 effectively prevent the sealing member 29 from being accidentally removed from the air vent aperture 28. Referring to FIG. 5, if the air vent aperture 28 is disposed at a slant, closure of the upper edge of the air vent aperture 28 does not cause the situation disclosed in the prior art of FIG. 14 to effectively prevent water from entering the air vent aperture 28. This reliably prevents water entrance into the spark plug mounting hole 22. FIG. 6 illustrates a second preferred embodiment according to the present invention wherein a plurality of circumferential ledges 35 are formed on an upper surface of the inner valve portion 32 for movement toward and away from the lower end periphery of the air vent aperture 28. When the inner valve portion 32 is in contact with the lower end periphery of the air vent aperture 28, the communicating passage is formed such that the vent channel 27 communicates with the atmosphere through gaps between the respective ledges 35 and a gap between an outer peripheral surface of the shaft portion 30 and an inner peripheral surface of the air vent aperture 28.

Figure 7:
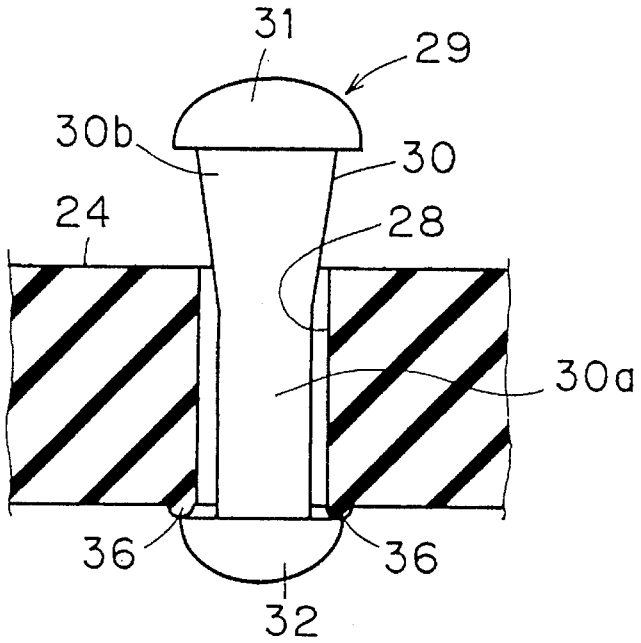
FIG. 7 is an enlarged view of major portions of a third preferred embodiment according to the present invention.

FIG. 7 illustrates a third preferred embodiment according to the present invention wherein a plurality of circumferential ledges 36 are formed at the lower end periphery of the air vent aperture 28 for contact with the inner valve portion 32 movable toward and away from the lower end periphery. When the inner valve portion 32 is in contact with the lower end periphery of the air vent aperture 28, the communicating passage is formed such that the vent channel 27 communicates with the atmosphere through gaps between the respective ledges 36 and the gap between the outer peripheral surface of the shaft portion 30 and the inner peripheral surface of the air vent aperture 28.

Figure 8:
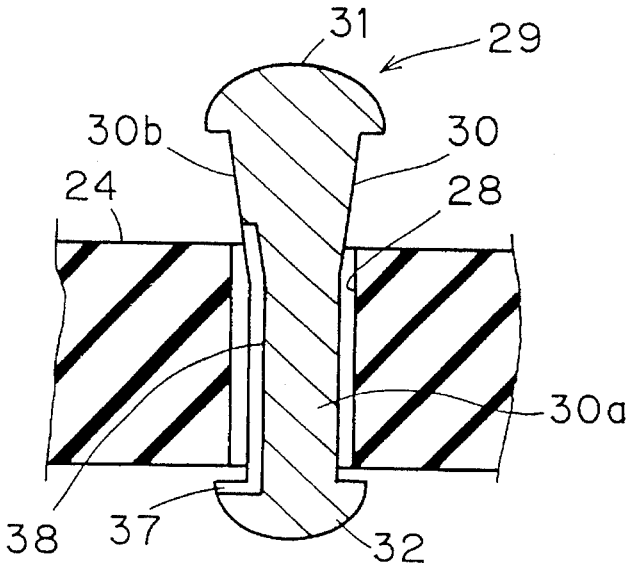
FIG. 8 is an enlarged view of major portions of a fourth preferred embodiment according to the present invention.

FIG. 8 illustrates a fourth preferred embodiment according to the present invention wherein the inner valve portion 32 defines a first channel portion 37 in the upper surface thereof. The shaft portion 30 defines in the outer peripheral surface thereof a second channel portion 38 extending vertically along the length of the shaft portion 30 and communicating with the first channel portion 37. The first and second channel portions 37 and 38 form the communicating passage such that the vent channel 27 communicates with the atmosphere.

Figure 9:
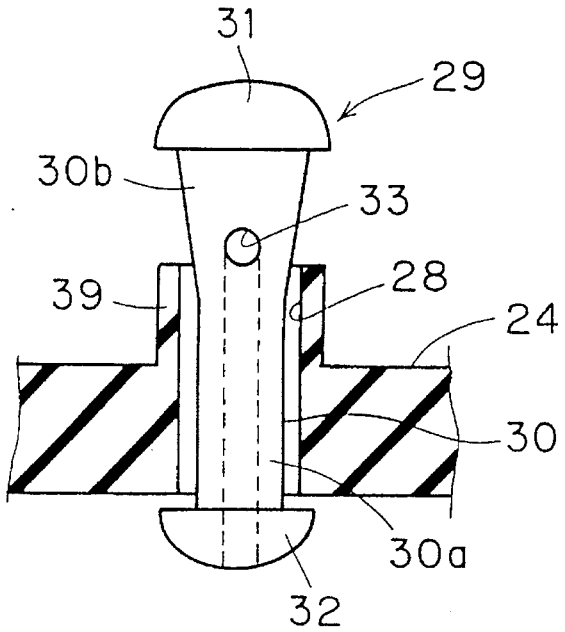
FIG. 9 is an enlarged view of major portions of a fifth preferred embodiment according to the present invention.

FIG. 9 illustrates a fifth preferred embodiment according to the present invention wherein the rain cover 24 includes a thin-walled cylindrical portion 39 at the upper end periphery of the air vent aperture 28. The thin-walled cylindrical portion 39 is easily subjected to elastic deformation to insure the closed state by the tapered shaft portion 30*b*.

Figure 10:
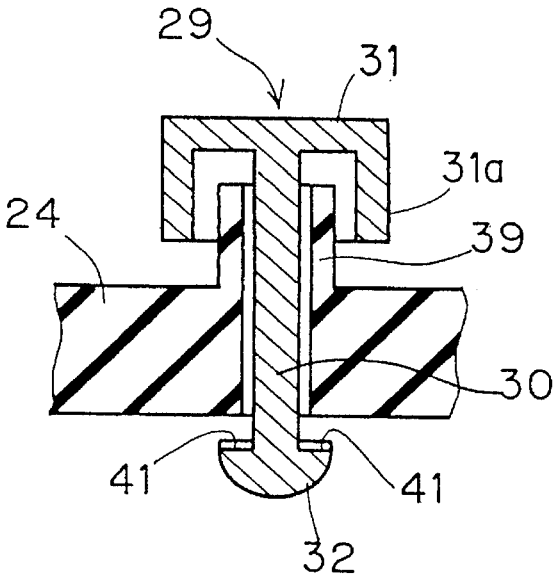
FIG. 10 is an enlarged view of major portions of a sixth preferred embodiment according to the present invention.

FIG. 10 illustrates a sixth preferred embodiment according to the present invention wherein the outer valve portion 31 includes a surrounding peripheral wall portion 31*a* surrounding the thin-walled cylindrical portion 39 in spaced apart relation to the outer periphery of the thin-walled cylindrical portion 39. Thus, the water entrance into the air vent aperture 28 becomes more difficult. A plurality of radial channel portions 41 are formed in the upper surface of the inner valve portion 32 in circumferentially spaced relation. The communicating passage is formed such that the vent channel 27 communicates with the atmosphere through the channel portions 41 and the gap between the outer peripheral surface of the shaft portion 30 and the inner peripheral surface of the air vent aperture 28.

Figure 11:
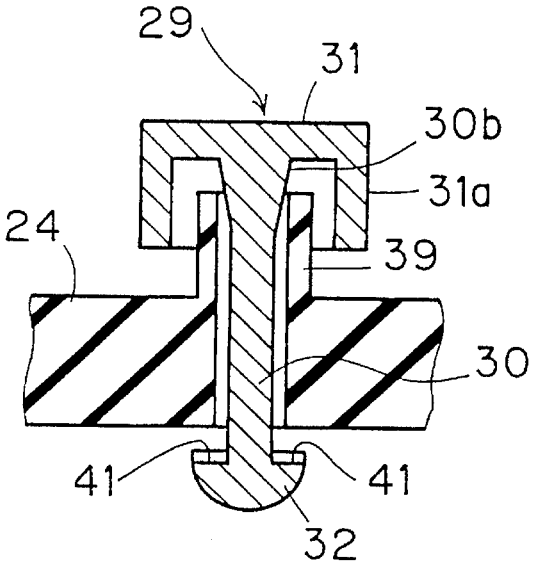
FIG. 11 is an enlarged view of major portions of a seventh preferred embodiment according to the present invention.
Figure 12:
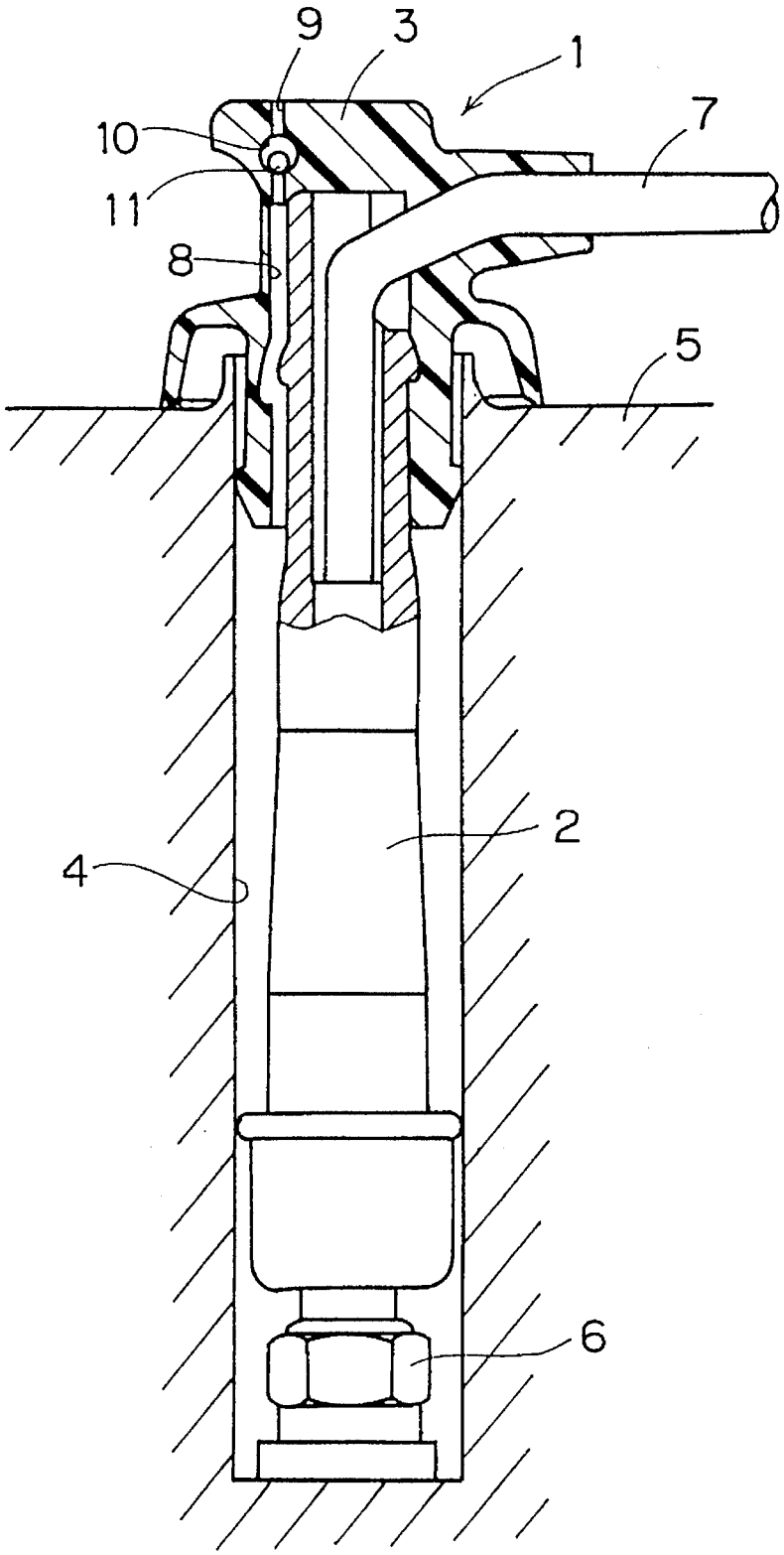
FIG. 12 is a fragmentary sectional view of the prior art.
Figure 13:
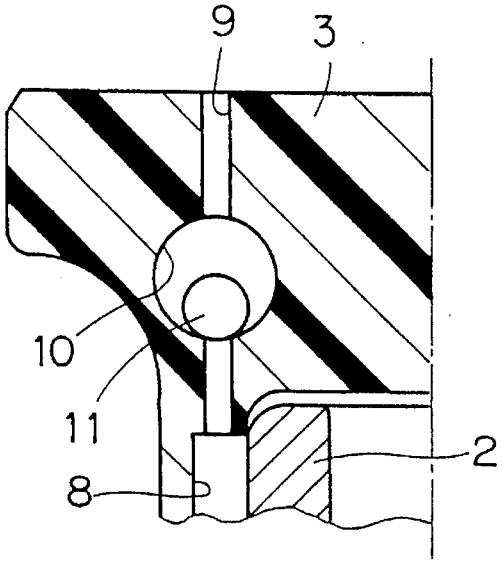
FIG. 13 is an enlarged view of major portions of the prior art.

FIG. 11 illustrates a seventh preferred embodiment according to the present invention wherein an upper portion of the shaft portion 30 of the sixth preferred embodiment includes the tapered shaft portion 30*b* for improvement in closing property.

Like reference numerals and characters are used to designate identical parts in the above mentioned preferred embodiments and the description thereof is omitted. The configuration of the sealing member 29 is not limited to those of the preferred embodiments.

While the invention has been shown and described in detail, the foregoing description is in all aspects illustrative and not restrictive. It is therefore understood that numerous modifications and variations can be devised without departing from the scope of the invention.

What is claimed is:

1. A plug cap device comprising:

a tubular plug cap body removably inserted in a spark plug mounting hole formed adjacent an engine;

a rain cover receiving an upper end portion of said plug cap body and closing an opening end of said spark plug mounting hole, said rain cover including an air vent aperture for communication between said spark plug mounting hole and the atmosphere; and a sealing member including a shaft portion extending through said air vent aperture for movement with play, and outer and inner valve portions formed on projecting portions at opposite ends of said shaft portion, said outer and inner valve portions being greater in size in a diametrical direction than said air vent aperture, said sealing member further including a closing portion for closing an outer edge of said air vent aperture by movement of said sealing member toward said spark plug mounting hole, and a communicating passage for allowing said spark plug mounting hole to communicate with the atmosphere by movement of said sealing member away from said spark plug mounting hole.

2. The plug cap device of claim 1, wherein there is provided a vertically extending vent channel between an outer peripheral surface of the upper end portion of said plug cap body and an inner peripheral surface of said rain cover, and said air vent aperture is formed at an upper end of said rain cover and extends vertically for communication between said vent channel and the atmosphere.

3. The plug cap device of claim 1, wherein said closing portion is a tapered shaft portion of said shaft portion having a diameter gradually increased away from said spark plug mounting hole, and said communicating passage is a vent extending from said inner valve portion within said spark plug mounting hole through said shaft portion to a side face of said tapered shaft portion.

4. The plug cap device of claim 1, wherein said inner valve portion within said spark plug mounting hole includes a plurality of ledges formed adjacent said air vent aperture and movable toward and away from a periphery of said air vent aperture for contact therewith, said closing portion is a tapered shaft portion of said shaft portion having a diameter gradually increased away from said spark plug mounting hole, and said communicating passage is gaps between said ledges and a gap between an outer peripheral surface of said shaft portion and an inner peripheral surface of said air vent aperture.

5. The plug cap device of claim 1, wherein said rain cover includes a plurality of ledges formed at a periphery of said air vent aperture within said spark plug mounting hole for contact with said inner valve portion movable toward and away from the periphery of said air vent aperture, said closing portion is a tapered shaft portion of said shaft portion having a diameter gradually increased away from said spark plug mounting hole, and said communicating passage is gaps between said ledges and a gap between an outer peripheral surface of said shaft portion and an inner peripheral surface of said air vent aperture.

6. The plug cap device of claim 1, wherein said inner valve portion within said spark plug mounting hole includes a first channel portion adjacent said air vent aperture, said shaft portion includes in an outer peripheral surface thereof a longitudinally extending second channel portion communicating with said first channel portion, said closing portion is a tapered shaft portion of said shaft portion having a diameter gradually increased away from said spark plug mounting hole, and said communicating passage is said first and second channel portions.

7. The plug cap device of claim 3, wherein said rain cover is formed of an elastic material, and said rain cover includes a thin-walled cylindrical portion at an upper end periphery of said air vent aperture.

8. The plug cap device of claim 1, wherein said rain cover is formed of an elastic material, said rain cover includes a thin-walled cylindrical portion at an upper end periphery of said air vent aperture, said outer valve portion outside said spark plug mounting hole includes a surrounding peripheral wall portion for surrounding said thin-walled cylindrical portion in spaced apart relation to an outer periphery of said thin-walled cylindrical portion, said inner valve portion within said spark plug mounting hole includes a channel portion adjacent said air vent aperture, and said communicating passage is said channel portion and a gap between an outer peripheral surface of said shaft portion and an inner peripheral surface of said air vent aperture.

9. The plug cap device of claim 8, wherein said closing portion is a tapered shaft portion of said shaft portion having a diameter gradually increased away from said spark plug mounting hole.

* * * * *